US005409202A

United States Patent [19]

Naramore et al.

[11] Patent Number: 5,409,202

[45] Date of Patent: Apr. 25, 1995

[54] INTEGRAL DISK TYPE INVERTER-STACKER AND STAPLER

[75] Inventors: Raymond A. Naramore, Webster; William E. Kramer, Wolcott, both of N.Y.

[73] Assignee: Xerox Corporation, Stamford, Conn.

[21] Appl. No.: 214,525

[22] Filed: Mar. 18, 1994

[51] Int. Cl.[6] ..... B31B 1/68

[52] U.S. Cl. ..... 270/53

[58] Field of Search ..... 270/53; 271/187, 315; 355/324

[56] References Cited

U.S. PATENT DOCUMENTS

| | | | |
|---|---|---|---|
| 4,473,219 | 9/1984 | Ichikawa | 271/187 X |
| 4,638,993 | 1/1987 | Granzow et al. | 271/187 X |
| 4,828,243 | 5/1989 | Ebihara | 271/187 X |
| 5,058,880 | 10/1991 | McGraw et al. | 271/187 X |
| 5,104,282 | 4/1992 | Gleason | 271/187 X |
| 5,114,135 | 5/1992 | Evangelista et al. | 271/187 |
| 5,201,517 | 4/1993 | Stemmle | 271/291 |
| 5,261,655 | 11/1993 | Keller et al. | 271/187 |
| 5,288,062 | 2/1994 | Rizzolo et al. . | |

FOREIGN PATENT DOCUMENTS

| | | | |
|---|---|---|---|
| 3521471 | 4/1986 | Germany | 270/53 |
| 0709396 | 1/1980 | U.S.S.R. | 270/53 |

OTHER PUBLICATIONS

Xerox Disclosure Journal vol. 18, #3, May/Jun., 1993, Author: Bruce J. Parks pp. 289–292–"Process Direction Offsetting of Sheets on a Stack".

Xerox Disclosure Journal vol. 4, #1, Jan./Feb. 1979, Author: Feil & Tesch p. 59–"Staple Head Positioning System".

*Primary Examiner*—John E. Ryznic

[57] ABSTRACT

A sheet inverting and stacking system in which a rotatable sheet stacking unit receives the lead edge area of an incoming sheet and then rotates and releases that lead edge area of the sheet at a lead edge registration position for stacking the sheet inverted in a set of stacked sheets at least partially on a stacking tray in a stacking area; with a movable sheet registration system providing plural sheet lead edge registration positions; a sheet set fastening system (stapler) for fastening the stacked sets; a first registration position for set fastening in which the sheet stacking area extends into the sheet set fastening system and a second registration position in which the sheet stacking is in front of the sheet fastening system, to provide two different initial sheet leading edge stacking positions and one final stacking position. The rotatable sheet stacking unit is interdigitating with the movable registration system to carry the sheet lead edge directly into the first or second registration positions and also into the sheet fastening system in the first registration position. The stapler is under and at least partially inside of the rotatable sheet stacking unit, and the rotatable sheet stacking unit slots carry the lead edge area of the incoming sheet directly up to the first registration position and into the stapler before releasing it. The sheet lead edge retaining slots have low force retaining spring members which lightly hold the lead edge of the sheet against one side of the slot.

12 Claims, 5 Drawing Sheets

INTEGRAL DISK TYPE INVERTER-STACKER AND STAPLER

Disclosed herein is an improvement in sheet "disk type" stackers or other such inverter-stackers. Some examples of disk stackers are disclosed in Xerox Corporation U.S. Pat. Nos. 4,431,177; 5,058,880; 5,065,996; 5,114,135 (see below); 5,145,167, issued Sep. 8, 1992, entitled "Disk Stacker Including Trail Edge Transport Belt for stacking Short and Long Sheets"; U.S. Pat. No. 5,261,655 issued Nov. 16, 1993, entitled "Disk stacker with Intermittent Corrugation Assistance for Small Sheets"; and U.S. Pat. No. 5,172,904 issued Dec. 22, 1992; and other references cited therein.

Also noted by way of background and art is Xerox Disclosure Journal publication Vol. 18, No. 3, May/-June, 1993, p. 289–292, by Bruce J. Parks, titled "Process Direction Offsetting of Sheets on a Stack". In this disk stacker disclosure, an apparatus for offsetting sheets in the process direction is described but involving a pair of differently moving registration walls 24, and not involving stapling.

Disk type stackers desirably provide both sheet inversion and stacking with sheet control in a small area. The incoming sheet lead edge area is captured temporarily in a slot or other temporary gripper in a rotating finger slot of a rotating disk system which flips the sheet over to invert it, and at the same time, guides the sheet lead edge down towards or onto the stack and against a sheet end edge registration wall. Inverted sheet stacking allows for facedown versus faceup stacking, which can be desirable for forward or 1 to N order printing, collated stacking, and other applications. Some disk stackers also provide side tamping of incoming sheets for lateral offsetting of separate jobs. It is noted that a disc stacker is sometimes referred to as a windsor stacker.

It is noted that even in printer copy architectures in which simplex copies do not need to be inverted for collated stacking, duplex (two sided) copies may require two inversions; one after the first side printing or first pass, and then another inversion to reorient the duplex sheet after its second printing pass before it is outputted. Thus, in an environment in which duplex copies are increasingly preferred for paper savings, output inversion may be increasingly required. A disk stacker provides an inversion in the system without the requirement of an internal or intervening conventional sheet reversing type inverter, which is considered more jam-prone and less accessible to the operator for jam clearance than a disk stacker. A disk stacker is largely exposed for jam clearances at the exterior output end of the machine.

Regarding another disk stacker feature, said U.S. Pat. No. 5,114,135 entitled "Disk Stacker Including Registration Assist Device" states in its Abstract: "A registration assist device is provided which presses a sheet located in the slot of a disk against a surface of the disk for a time period which begins prior to and extends until just after the time when a leading edge of the sheet contacts a registration wall which strips the sheet from the disk slot. This pressing of the sheet causes a drag force to be applied to the sheet so that the leading edge of the sheet is re-registered with the registration wall to compensate for any bouncing of the sheet away from the registration wall after initial contact therewith. Preferably a foam roller is moved into and out of a curved plane defined by the disk slot in timed relation to the rotation of the disk to press the sheet against the slot surface. The use of a foam roller provides a variable force to the sheets depending on the weight of each sheet so that higher drag and pressing forces are applied to heavier weight sheets which require and are able to withstand higher force."

The disclosure herein includes an improved system for stacking printed sheets into inverted sheet sets and also for fastening these sets, as by stapling or other binding. Such a stacker/stapler is particularly desirable for handling the sequential copy sheet output of various electrographic printing machines, especially where the sheets are printed topside or face up in 1 to N or forward serial page order and face down stacking is thus desirable, and/or for duplexing as discussed above.

In accordance with one disclosed aspect or feature, there is provided here an improved sheet stacking apparatus generally of the disk stacking type capable of stacking and fastening sets of a wide variety of copy sheets reliably with improved, more positive, sheet control and registration, reliable stacking, and providing set fastening for on-line finishing with no significant increases in the space or components required over unfastened sets stacking, yet unfastened stacking is also compatably provided. Stapling is simplified and does not require complex mechanisms to move the stapler in and out of the stapling position. In fact, stacking and registration of the set for set stapling can even be done into the open jaws of a stationary stapling head in the illustrated embodiment.

By way of further background, of some art on the general subject of in-bin or post-collated job set stapling in sorters, there is noted, e.g., Xerox Corporation U.S. Pat. No. 3,884,408 to L. Leiter et al.; U.S. Pat. No. 3,944,207 to Bains; U.S. Pat. No. 3,995,748 to Looney; U.S. Pat. No. 4,687,191 to Stemmle; U.S. Pat. No. 4,681,310 to Cooper; and U.S. Pat. No. 4,925,171 to Kramer, et al. Also, Xerox Corporation R/84007 U.K. 2 173 483-A GB published 15 Oct. 1986 by Denis Stemmle; and R/81011 U.S. Pat. No. 4,687,191 issued Aug. 18, 1987. Also noted is U.S. Pat. No. 4,083,550 issued Apr. 11, 1978 to R. Pal. Other Xerox Corporation patents include Snellman et al U.S. Pat. No. 4,145,241 and Hamlin et al U.S. Pat. No. 4,564,185 on edge jogging and glue binding sets in a sorter or collator and/or stapling of the post-collated copy sets. Withdrawal of the sets from the respective bins with a gripper extractor for on-line stapling as in the Xerox Corporation "9900" copier is shown for example in Xerox Corporation U.S. Pat. No. 4,589,804 to Braun et al.; U.S. Pat. No. 4,361,393 to Noto and U.S. Pat. No. 5,024,430 issued Jun. 18, 1991 to Nobuyoshi Seki et al. (Ricoh) which also returns stapled sets to the bin, and has a stapler movable along the array of bins. Recent Japanese owned patents in this area include U.S. Pat. No. 4,762,312 issued Aug. 9, 1988 to Y. Ushirogatn (Ricoh); Minolta U.S. Pat. No. 4,801,133 issued Jan. 31, 1989; U.S. Pat. No. 5,217,215 to Y. Ohata, "Sorter and Stapler With Rotating Gate"; and several Canon patents and EPO patent application publications on in-bin stapling systems such as EP 301-594, 5, and 6-A. Also, U.S. Pat. No. 5,125,634 issued Jun. 30, 1992 to Frederick J. Lawrence (Gradco); U.S. Pat. No. 5,131,642 issued Jul. 21, 1992 to Hiroshi Yamamoto (Ikegami Tsushinki) and U.S. Pat. No. 5,150,889 issued Sep. 29, 1992 to Taguchi (Mira).

As may be seen from the above and other references, integral sorter/stapler units with in-bin stapling are well known. However, typically, as disclosed therein, heretofore the stapler unit must move or pivot partially into and out of each bin for each stapling of each compiled copy set therein, or the compiled set must be moved out of the bin, stapled and moved back into the bin, or the bin must laterally move or pivot into the stapler unit. Not only does this require complex mechanisms and drives, it can affect stack registration and/or require skipped pitches (non-print cycles) for stapling.

Moving a single stapler head linearly along one edge of a stack of sheets being collated in a single bin or tray to desired positions, in order to insert a plurality of staples along that edge of the stack with one stapler, is known. An example is shown in the Xerox Disclosure Journal Publication Vol. 4, No. 1, January/February 1979, p. 59, as well as patents cited herein. Relevant for that disclosure as well as for compiling in a stapler throat (open jaws) is commonly assigned pending U.S. application Ser. No. 08/007,948 filed Jan. 25, 1993 (D/92331), being continued.

Of particular interest, Xerox Corporation U.S. Pat. No. 5,201,517 to Stemmle shows an orbiting nip stacking inverter 20, which in orbit nip position 27' (FIG. 1) feeds sheets to a set of registration fingers 16 (which at that time are positioned behind a normal stacking wall 14*a*) until the set is compiled and stapled in that position by a stationary single corner stapler 16 (see FIG. 2), whereupon, as shown by the dashed line movement arrows in FIGS. 1 and 2, finger 16 push the stapled set forward to stack on an inclined elevator tray 14 aligned with stacking wall 14*a*.

By way of background, in-bin stapling is typically used in a post-collation sorter module at the output of an automatic copying machine which does not have recirculating document set capability, wherein reproduction of multipage originals or sets of documents is made by sequentially making the desired number of copies of a first page in the set, collecting these copies in separate individual trays or bins of the sorter, then sequentially making the desired number of copies of the second and subsequent pages of the set and respectively stacking them in the sorter bins on top of the first page copies, etc., repeating this for all of the documents, and thereafter stapling the now collated copy sets in each bin. The staple head can be movable vertically relative to the array of bins, or the bin array can move vertically past a stapler maintained at a constant vertical level. In plural bin sorter systems, circulation for copying of the document set more than once is not required, providing the number of empty bins available exceeds the number of collated copy sets being made at that time.

If, in contrast, precollated copy sets output is provided, by a recirculating document handler or an electronic printer (which can reorder pages for printing) (well known per se), then a single compiler tray may be used to stack and align sheets for stapling or otherwise finishing each collated copy set, one at a time. The registered and stapled set may then be ejected. If stacking was into an "uphill" stacking tray, a set ejector may be provided. Single tray or partial tray copy set compiler/staplers besides those noted above are disclosed, for example, in U.S. Pat. No. 5,098,074, issued Mar. 24, 1992 by Barry P. Mandel, et al; and U.S. Pat. Nos. 4,417,801; 4,541,626; 5,120,047; and 5,201,517. Other compiler/staplers are shown in commonly assigned Xerox Corporation U.S. Pat. No. 5,288,062 and allowed U.S. application Ser. No. 08/057,941 filed May 7, 1993 by Richard S. Smith (D/92357).

It may also be seen from the cited art that if "downhill" stacking into a downwardly inclined stacking tray is provided, the downstream upstanding registration edge can be removed or opened, so that the copy set can slide out of the tray by a gravity after the sheets have been registered. This may be desirable after the set is stapled, so that stapled sets may be collected elsewhere. (Ejecting unstapled sets can misalign or scatter the sheets in the set.)

Further by way of background on sheet stacking difficulties in general, outputted sheets are usually ejected or fed into a stacking tray from above one end thereof. Normal output stacking is by ejecting sheets from above one end of the top sheet of the stack of sheets onto which that additional ejected sheet or sheets must also stack. Typically, each sheet is ejected generally horizontally (or slightly uphill initially) and continues to move horizontally by inertia, and with gravity if stacking is "downhill", or slowed or reversed by gravity if "uphill" stacking. That is, unlike the system disclosed herein, stacking sheets are not typically effectively controlled or guided once they are released into the stacking tray area. The sheets typically fall by gravity into the tray by a substantial distance before they settle onto the top of the stack. However, sheet settling (falling) is resisted by the relatively high air resistance of the sheet to movement in that direction. Yet, for high speed reproduction machines output, sheet stacking must be done at high speed, so a long sheet settling time is undesirable.

The stacking of sheets is made even more difficult where there are variations in thickness, material, weight and condition (such as curls), in the sheets. Different sizes or types of sheets, such as tabbed or cover sheets, transparencies, or Z-folded or other inserts, may even be intermixed in the copy sets in some cases. The sheet ejection trajectory and stacking should thus accommodate or handle the varying aerodynamic characteristics or tendencies of such various rapidly moving sheets. A fast moving sheet can act as a variable airfoil to aerodynamically affect the rise or fall of the lead edge of the sheet as it is ejected. This airfoil effect can be strongly affected by curls induced in the sheet, by fusing, color printing, etc. Thus, typically, a restacking ejection upward trajectory angle and substantial release height is typically provided, well above the stack height or level at the sheet ejection point. Otherwise, the lead edge of the entering document can catch or snub on the top of the sheet stack already in the restacking tray, and curl over, causing a serious stacking jam condition. However, setting too high a document ejection level to accommodate all these possible restacking problems greatly increases the sheet settling time for all sheets, as previously noted, and creates other potential problems, such as sheet scattering. Thus, better controlled stacking, as can be provided by disk type stacking, is also desirable for that reason.

Besides the customer unacceptability of stapling together a job set with misaligned or scattered sheets, sheet scatter has at least three other negative consequences. First, if the stacker assembly has a sets offsetting feature, intended to provide job set separations or distinctions, scatter within a stack makes such set distinction more difficult. Secondly, a stack within which individual sheets are not well aligned to each other is more difficult for an operator to grasp and remove from the stacker. Thirdly, a misaligned stack is not easily loaded into a box or other transporting container of corresponding dimensions.

The system disclosed herein overcomes various of the above and other problems without sacrificing the desired output and stacking positions for the outputted sheets, or without requiring a complex or costly stapler movement mechanism.

Further specific features disclosed in the examples herein, individually or in combination, include those wherein a sheet inverting and stacking system in which a rotatable sheet stacking unit receives the lead edge area of an incoming sheet and then rotates the received sheet lead edge area and releases that lead edge area of the sheet at a lead edge registration position for stacking the sheet inverted in a compiled set of stacked sheets at least partially on a stacking tray in a stacking area: a plural position movable sheet registration system providing plural said sheet lead edge registration positions; a sheet set fastening system for fastening the inverted compiled sets of stacked sheets; said plural position movable sheet registration system providing a first registration position for set fastening in which said sheet stacking area of the sheets being compiled inverted extends into said sheet set fastening system; said plural position movable sheet registration system providing a second registration position in which said sheet stacking area is in front of said sheet fastening system; and said rotatable sheet stacking unit comprising rotating sheet retaining slot elements interdigitating with said plural position movable registration system to carry the sheet lead edge directly into said first and second registration positions and also into said sheet fastening system in said first registration position; and/or wherein said first and second registration positions provide two different initial sheet leading edge stacking positions, but only one final sheet stacking position; and/or wherein said movable sheet registration system is automatically moved from said first registration position to said second registration position after said sheet set fastening system has fastened a compiled set of stacked sheets so as to stack fastened sets in said second registration position; and/or wherein sheets stacked in said first registration position are stacked in substantially the same plane as sheets stacked in said second registration position; and/or wherein said sheet set fastening system comprises a stapler with open stapling jaws extending through said first registration position; and/or wherein said movable sheet registration system is a plural mode system providing an upstanding sheet lead edge registration wall for set compiling, a fastened sheet set ejector, and a plural sets registration wall in respective said modes thereof; and/or wherein the distance between said first and second registration positions is less than about 3 cm; and/or wherein said sheet lead edge sheet retaining elements include low force retaining spring members therein which lightly hold the lead edge of the sheet against one side of a slot but do not substantially resist the entrance or exit of the sheet lead edge from the slot; and/or wherein said stapler is under said rotatable sheet stacking unit, and said slot elements of said rotatable sheet stacking unit carries the lead edge area of the incoming sheet directly up to said first registration position and into said stapler before releasing it; and/or wherein said stapler is stationary and at least partially inside of said rotatable sheet stacking unit; and/or wherein a lateral sheet tamping system engages the side of a sheet in said slots opposite from said fastening system to move the sheet into said fastening system; and/or wherein said low force retaining springs assist in the control of lateral tamping of a sheet lead edge in said slots.

In the description herein the term "sheet" refers to a usually flimsy sheet of paper, plastic, or other such conventional individual image substrate, "output" or "copy sheet". Related, e.g., page order, plural sheets may be referred to as a "set" or "job".

All references cited in this specification, and their references, are incorporated by reference herein where appropriate for appropriate teachings of additional or alternative details, features, and/or technical background. The disclosed apparatus does not require unconventional control systems or software that is not readily programmable.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Figure 1:
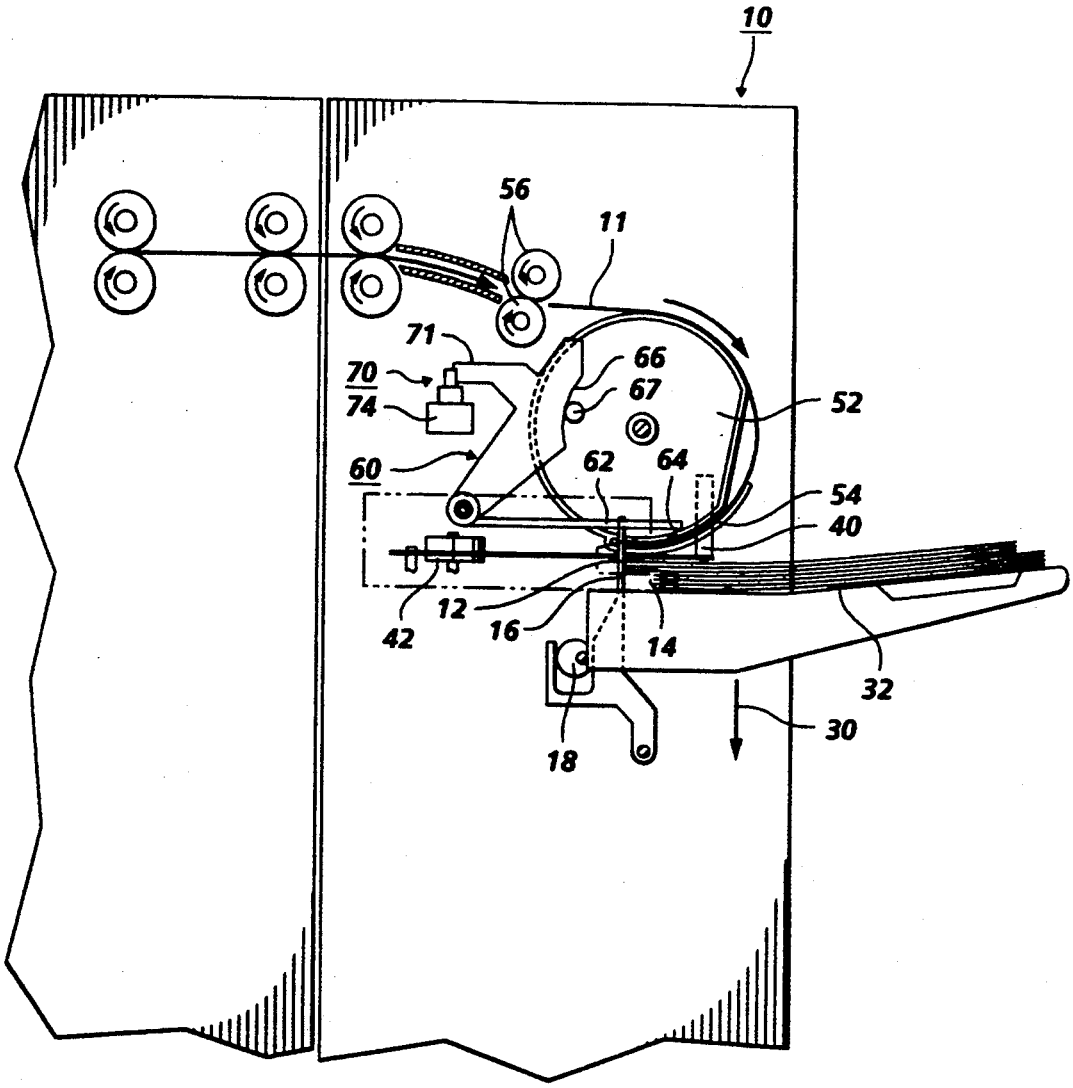
FIG. 1 is a partially schematic side view of one embodiment of the subject disk stacking and stapling system, showing a sheet entering the system from a printer output.

There is illustrated in FIGS. 1–5 one exemplary feeder/stacker/stapler unit or module 10. The known aspects of disk stacker operation per se are discussed in detail in the cited references and need not be redescribed in detail here. This exemplary disclosed integral disk stacker/stapler system 10 differs significantly in that among other features there are two different incoming sheet 11 leading edge registration positions 12 and 14, providing two different initial stacking positions, but one final stacking position 14. These two different initial stacking positions 12 and 14 can be provided by two different positions of movable registration fingers 16, illustrated in solid and phantom lines, respectively. Any suitable mechanisms, such as eccentric cam 18, can be used to move the registration fingers 16 between the positions 12 and 14. The first of these two different positions 12 and 14 of fingers 16 provides a first stacking edge position 12 which is parallel to but behind the normal registration edge position 14. This first position 12 here provides stacking of the sheets 11 for stapling by stapler 20, by registering the stack within the stapler jaws opening 22. The second stacking position 14 is at the normal registration plane or edge and is used here for unstapled stacking. That is, when unstapled stacking is selected, controller 100 activates cam 18 to move fingers 16 outboard to position 14. When set stapling is selected, controller 100 moves fingers 16 back to position 12. The second stacking position 14 is also here the position for stapled set ejection fully onto a stacking elevator tray system 30 stacking surface 32. That is, the final stacking position here is at registration line 14 for both stapled and unstapled sets, on stacking tray (elevator platform) 32.

The registration fingers 16 here thus provide a dual mode function as set ejectors or kickers for ejecting the stapled set after its stapling out fully onto the elevator tray 32.

Elevator platform 32 may be moved vertically by a screw drive or other known elevator system 30. As the elevator drive is rotated by a motor, elevator platform 32 is raised or lowered. A stack height sensor (described below) may be used to control the movement of platform 32 so that the top of the stack remains at substantially the same level.

Figure 2:
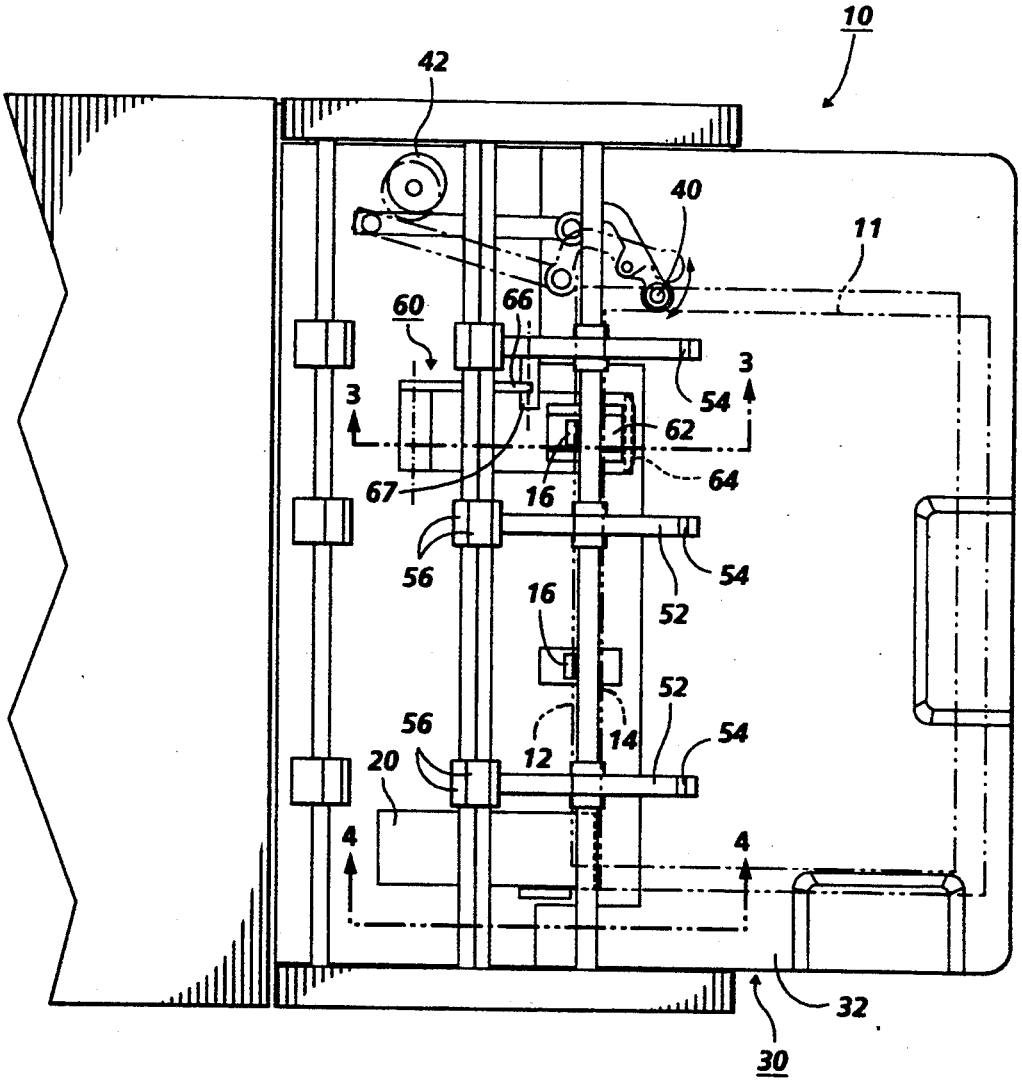
FIG. 2 is a top view of the embodiment of FIG. 1.

Here, as shown particularly in the stack set phantom outline of sheets 11 in the top view of FIG. 2, the incoming sheet path or position of the sheets 11 is laterally offset from the sheet path or process direction, i.e., laterally offset from both of the stacking positions. A lateral tamper system mechanism 40 tamps each incoming sheet sideways (laterally) into the stacking positions. That is, automatically tamping only the one incoming or top sheet sideways into or in front of the stapler 20, without tamping the stack edge so as not to interfere with plural sets offsetting. All incoming sheets are so tamped one at a time.

The illustrated lateral tamper system 40 for the incoming sheet is shown here as being driven by a cam 42 via pivotal lever arms from the sheet input drive system. Although it could also be operated by a solenoid, and spring loaded in the outboard or non-tamping position, preferably the tamper 40 motion is ramped to have a controlled acceleration movement by cam 42 or the like in order to control sheet inertia better. This can be provided by the shape of the tamper 40 drive cam 42 system. For variable sheet length end tamping, a multi-position tamper with a programmable stepper motor can be used.

The disclosed disk stacker registration apparatus and method example here further includes thin leaf springs or restrictor flaps 50 in the upstream portions of the disk 52 slots 54, angled downstream, to help hold the lead edge of the sheet 11 in the slots 54. These flaps 50 also frictionally damp the incoming sheets lateral movement while the sheet is being laterally tamped by tamper 40 towards the stapler 20 before stacking, above the stack, and without requiring any hard stop or wall type side registration edge on either side of the stack, although one can be conveniently provided, as shown in FIG. 2. Since disk stackers have at least two widely spaced disks 52 engaging both the top and bottom or right and left sides of the lead edge area of the sheet 11 entering the stacking area, the disks 52 act as if the sheet were being held with two hands in two different places in the respective slots 54 of the two disks. The leaf springs 50 act as if the sheet was being held in these two places with a light finger pressure. This finger-like pressure of the leaf springs 50 is sufficient to help retain the sheets 11 in the disk slots 54 but does not prevent lateral movement of the sheet by tamper 40. Lateral movement or edge tamping is desirable while the sheet 11 is in the disk slots 54 because the arcuate shape of the disk slots greatly increases the beam strength of the sheet 11 therein and thereby prevents buckling in the lateral direction as the sheet is tamped from one side or end toward the other. That is, the sheet 11 is column shaped from the disk radius at that point, preventing buckling in the cross direction. Meanwhile, the fingers 50 pressing the inside of the sheet against the outside of the disk slots 54 help hold the sheet there to prevent buckling of the sheet in the forward feeding direction of the sheet. This flattening restriction provided by the leaf spring 50 helps force the leading edge of the sheet firmly against the registration edge provided here by the registration fingers 16 as the disk is rotating therethrough.

It should also be noted that if a side tamper system such as 40 is not used, that as an alternative the entire disk system (all the disks 52 on their common axis) can be side shifted sideways for side edge registration of the sheet while it is in the disk, with the springs 50 holding the sheet while this is done.

Figure 3:
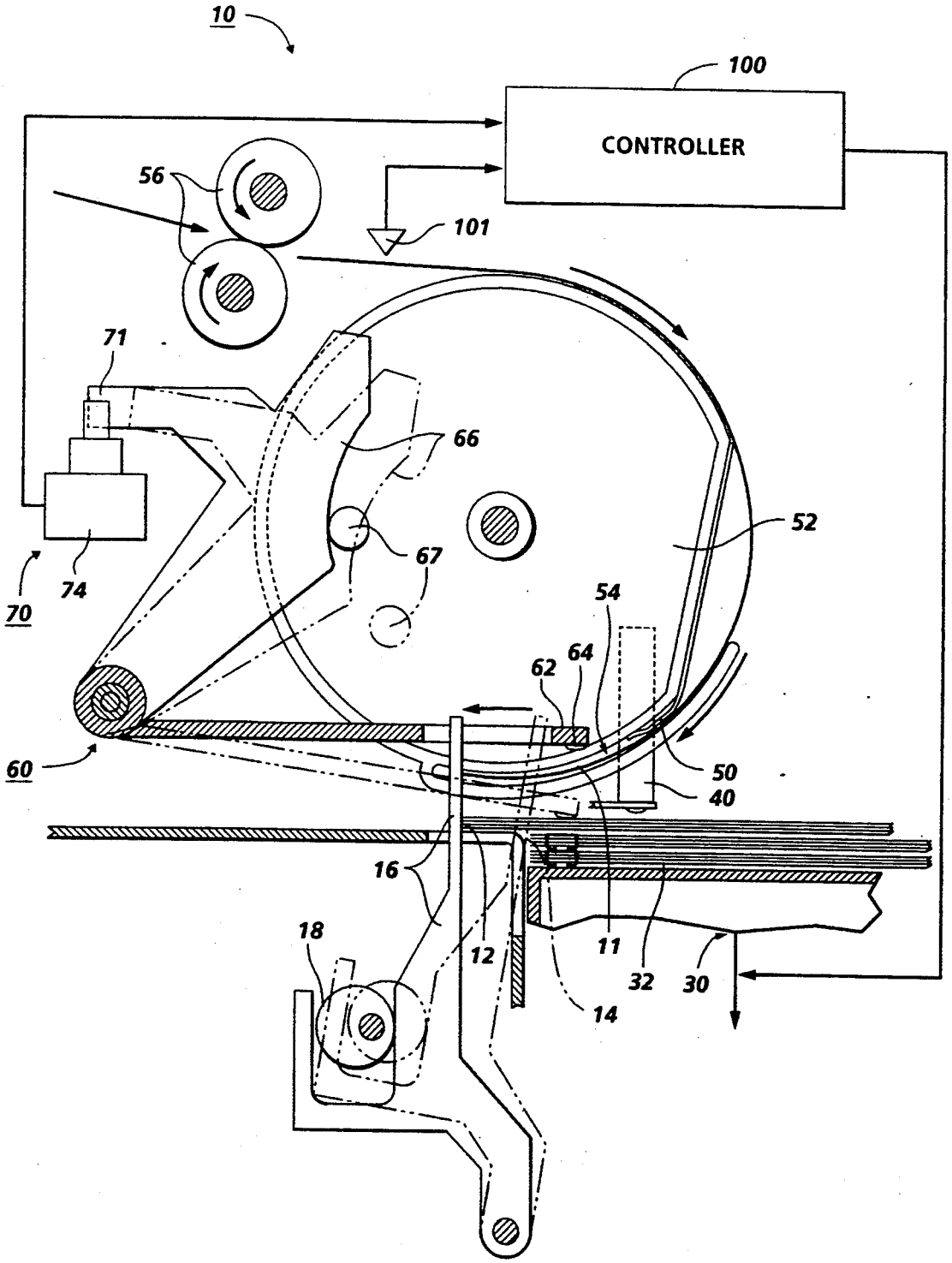
FIG. 3 is a partial enlarged cross-sectional side view of the embodiment of FIGS. 1–2 taken along lines 3—3 of FIG. 2 in the position in which the leading edge of an incoming sheet is just being registered by the disclosed system.
Figure 4:
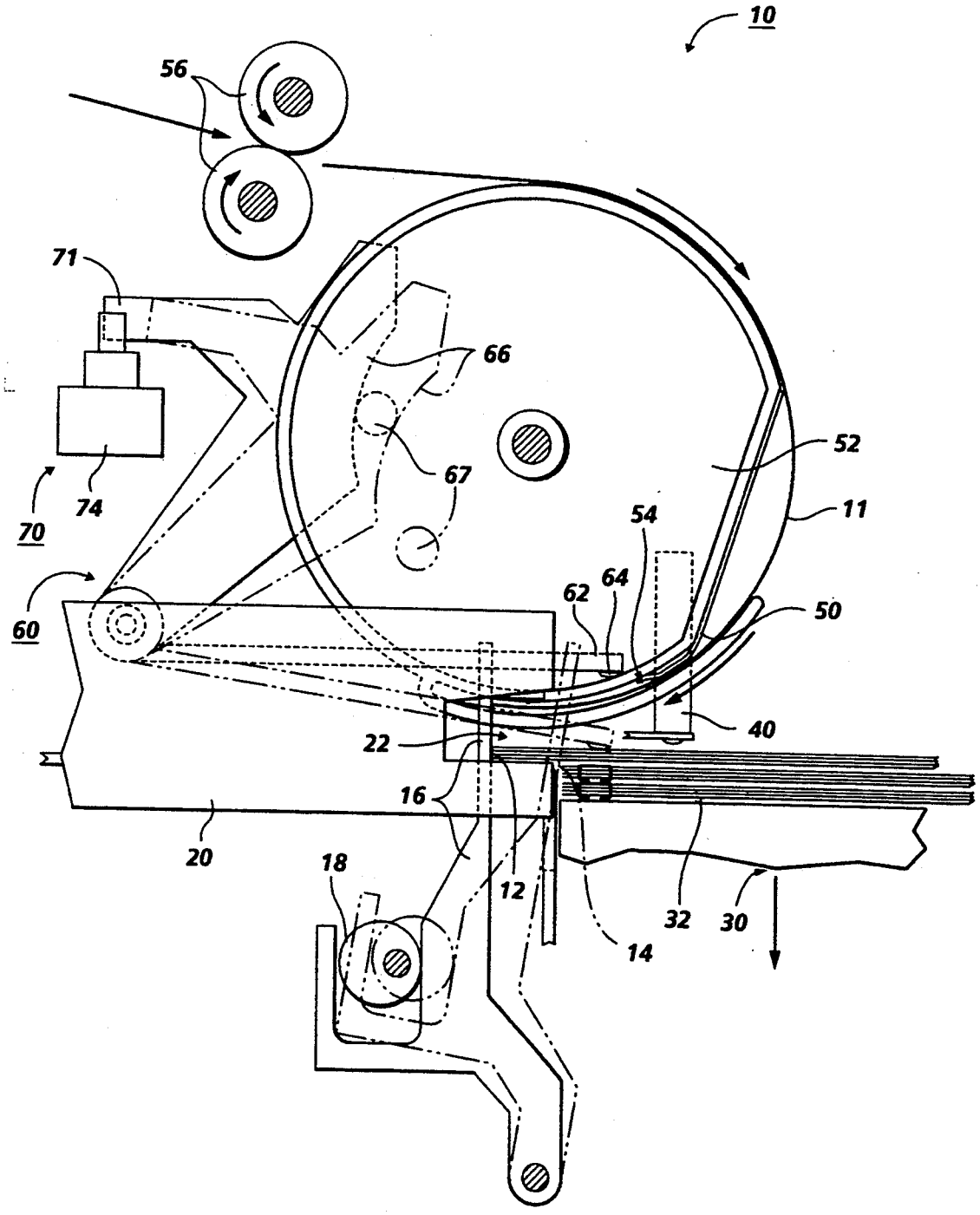
FIG. 4 is a view like FIG. 3 but taken along the cross-sectional line 4—4 of FIG. 2.

Also disclosed is a system to automatically delay incoming sheet lateral tamping by system 40 for long sheets (such as U.S. standard 17 inch sheets short edge fed) to allow the trail edge of the long sheet to clear the sheet input feed rolls 56 first. That is, as shown in FIG. 3, when the controller 100 and/or the conventional sheet path input sensor such as 101 detects a long sheet in the process direction, the actuation of the lateral tamping system 40 may desirably be delayed until the sensor 101 indicates that the trail edge of the long sheet has been released by the nip of sheet input feed rolls 56.

These leaf springs 50 in the throat of the disk stacker finger slots 54 provides a small but effective amount of normal force better holding the sheet 11 in the finger slots 54 so as to more positively feed or drive the sheet as it approaches the registration fingers 16 for better sheet lead edge registration. The spring retaining fingers 50 also provide resistance or friction to any tendency of the sheet to bounce back away from the registration fingers 16 after the sheet lead edge impacts the registration fingers. The amount of normal force applied by fingers 50 is preset, but will be set for the specific design constraints and configuration of the overall system. This normal force from the springs 50 against the sheet 11 in the throat 54 must be high enough to drive the sheet, but low enough not to retard the sheet entrance, that is the feeding-in by the upstream feed rollers 56 of the sheet into the slots 54. The amount of preset normal force of springs 50 can also be affected by possible corrugation of the sheet 11, depending upon the relative positions of the disk stacker slots 54, or other corrugating elements.

The unique "bail bar" system 60 here is actually an incoming sheet 11 knockdown or hold down member. More specifically, it provides a vertical tamper arm 62, with sheet engaging rubber end fingers 64, that is automatically moved down vertically for each inputted sheet 11, (rather than only after a full set circulation like an RDH bail bar). I.e., the tamper arm 62 comes down (from in between the disks 52 of the disk stacker) on top of the stack after each sheet 11 level edge passes under raised arm 62 fingers 64 and that sheet is released from the disk slots 54 to stack. The tamper arm fingers 64 push down the incoming top sheet 11 with only a light enough force to press down that one sheet onto the underlying sheets of the stack, but also prevents lateral sheet movement and thus prevents set scattering. The downward movement of the "bail bar" system 60 is thus just after the end of the disk slots 54 rotates past the registration fingers 16. It may stay down thereafter to hold the set until another sheet 11 is inputted. As shown, a cam 66 surface connecting with arm 62 and activated by a lateral pin 67 extending from and rotating with a disk 52 may desirably be used to drive or lift up the bail bar system 60 during the time the sheet 11 is being inverted and fed under the tamper arm 62 by the disk drive. Additional or plural bail bars (dropping weights which fall with the sheets) may be provided, e.g., to obtain even better sheet control near the stapler.

The tamper arm 62 also functions in this example as the sensor arm for a stack height sensing system 70 controlling the stacking tray elevator system 30. A flag 72 connecting with, or an extension of, the tamper arm 62 interrupts and activates a conventional optical switch 74 at the point when the top of the stack is stacked high enough to need to be lowered by lowering the stacking tray elevator 30 to lower its stacking surface 32.

Because the requirement for registering a set for stapling, i.e., compiling a set for finishing, is more critical than that for unstapled stacking, it is necessary to provide a registration system which provides a neat or registered and squared stack and also greater resistance to set scattering between registration and stapling. It has been found here that this may be preferably done to each incoming sheet in the disks 52, also insuring that the registration position provided to the sheet is not lost when the disk releases and drops the sheet onto the stack. The bail system 60 here provides this maintenance of the sheet registration position while the sheet is making the transition from the disk slots 54 to the top of the stack. The weight of the bail system normal force arm 62 coming down on the sheet 11 makes this movement consistent and provides a neat, registered, stack. The rubber fingers 64 on the ends of this arm 62 engaging the released sheet prevent the sheet 11 from attempting to move either laterally or longitudinally away from its initial registered position as it drops.

Describing now some of the common or prior art system elements of this disk stacker example, as shown in FIG. 1, an input to this unit or module 10 can be sheets fed from almost any, even high speed, copier or printer. The upstream device could be a printer, copier, another such disk stacker module, or a device for rotating sheets. (Sheets may need to be pre-rotated so that they have a desired orientation. The sheets 11 can thereby enter unit 10 long edge first or short edge first.) A bypass transport may also be provided to pass sheets on to another such unit 10. The disk stacker unit 10 example here includes a rotating disk type inverter with plural (at least two) disks 52. Each disk 52 includes two fingers defining two arcuate slots 54 for receiving the leading portion of a sheet 11 therein. The disks 52 rotate approximately 130 degrees after receiving a sheet 11 lead edge into disk slots 54, to invert the sheet and register the leading edge of the sheet against a registration wall (here the fronts of fingers 16) which strips the sheet from the disks slots 54 as the disks 52 rotate through (rotating between) fingers 16. The sheet 11 then is free to drop onto the top of the stack of previously inverted sheets. Herein, as previously described, the sheet stack is supported on an elevator tray 32 vertically repositioned by a supporting elevator system 30.

That is, the normal operation of the disk stacker unit is as follows: a sheet enters the input nip 56 and is then fed to the disks 52, which are notrotating at that time. Once the sheet is fed in sufficiently far enough into the disk slots 54 (controlled by preset timing) the disks 52 begin rotating together to carry the sheet 11 around to the registration wall provided by the fingers 16. The disks 52 continue their rotation until the sheet 11 is freed of the disk fingers slots 54 and is able to drop. The distance the sheet 11 has to drop after it is released from the slots 54 of the disks 52 is maintained at a correct, relatively small distance by the above-described operation of the elevator 30 of the stacking tray 32 and is controlled by the stack height sensor system 70. Note that the end of the disk slots 54 must move far enough to clear both of the two registration positions 12 and 14 of the two position registration wall 16 in this system.

The rotational movement of the disks 52 can be provided or controlled by a variety of means conventional in the art, such as a stepper motor, servo motor, or geneva cam drive. Preferably, a sheet lead edge sensor such as 101 located upstream of disks 52 detects the presence of a sheet 11 approaching the disks 52. In this example, the lead edge of the sheet is driven in to the bottom of the disk slots while the disks are stationary to preregister and deskew the sheet lead edge. Afer a predetermined (timed) amount of sheet buckle, the disks are rotated, maintaining the same speed for the sheet lead edge therein as from rolls 56, until the sheet registration position is reached.

Alternatively, as in cited prior systems, after the sheet 11 has at least partially entered the slots 54, the disks 52 may be rotated at a peripheral velocity which is about ½ the velocity of the input feed rolls 56 nip, so that the leading edge of the sheet 11 progressively further enters the disk slots 54. The disks unit there is rotated at a speed such that the leading edge of the sheet 11 contacts registration fingers 16 prior to contacting the end of the slot 54. Such a manner of control is disclosed in the above-cited Xerox Corporation U.S. Pat. No. 4,431,177 to Beery et al. This reduces the possibility of damage to the lead edge of the sheet.

After the sheet 11 is released for stacking, the unit may be stopped in a position to receive the next sheet from feed rolls 56. The disks 52 are preferably nylon or the like so that the slots 54 are slippery relative to the paper sheets and the elastomer drive rollers 56.

As illustrated herein, a single completely stationary stapler 20 can provide a corner edge staple in one corner of the sets being stapled. That is, no stapler reposition motion is required at all. However, it will be appreciated that the same system herein can allow use of one, or two, moving staplers for book stapling along the edge of the set at various positions. Such moving staplers are taught in above-cited art. Here, the stapler(s) may be located along the same line or plane, parallel to the sheet stack edge and underneath and at the back of the disk stacker unit, so as not to require any additional space. If moved along the set edge, they can move linearly. The staplers can be substantially within the cylindrical area of rotation of the disks 52, as shown, by being located between the disks or outside the end of one outside end disk, as here.

It may also be seen that in this system 10 the stacks of job sets of sheets 11 previously stapled together are supported in a stacked position corresponding to the forward position 14 of the set fingers 16, fully on the elevator tray 32, preferably aligned with the rear edge of tray 32, as shown, whereas the sheets currently being stacked, i.e., the next job set to be stapled, is offset rearwardly 12 of the process direction (and rearwardly of the tray 32 rear edge) by a sufficient distance to allow that set to be stapled without interfering with the rest of the sets. That is, a sufficient distance for the set being stapled is provided between positions 12 and 14 so that position 14 is sufficiently offset so that the stapler jaws 22 engage just that last set in position 12 without being obstructed by the previously stapled sets at position 14. The stapler 20 is just, but fully, behind the rear edge of tray 32 and position 14. The last set being stacked and stapled (the top set) is not hanging over unsupported beyond tray 32 by a distance which would cause it to sag to any substantial extent. That is, the portion of the sheets being stacked for stapling at the inner or second registration position 12 are only extending between the two positions 12 and 14 a distance of approximately 3 cm or less. Supporting surfaces, as the shelf here, or fingers, including the bottom jaw of the stapler itself, are desirably provided for at least partial support of this extended or protruding portion of the set being stapled, and control of curled down sheet edges.

To further describe the stapling operation, for a set of sheets to be stapled, once the complete set of copies (controller 100 knows the number of sheets in that job and sensor 101 counts their entrance) has been compiled at position 12 in the stapler 20 throat 22, the stapler drive motor or solenoid (conventional and thus not shown) is actuated, driving a staple into the set in a conventional manner. At this time, or shortly thereafter, the registration fingers 16 or other kicker wall is actuated and driven forward by cam 18 to position 14 to push the stapled set fully out onto the stacking tray 32, aligned with all of the previously stapled sets at registration line 14, as shown. If another set is to be compiled and stapled, the registration fingers 16 are then driven by cam 18 back to their rear position 12 once again to repeat the cycle. Otherwise the fingers 16 may remain out at position 14 to help maintain alignment of the stapled sets in their square stacking position on the elevator stacking tray 33.

Figure 5:
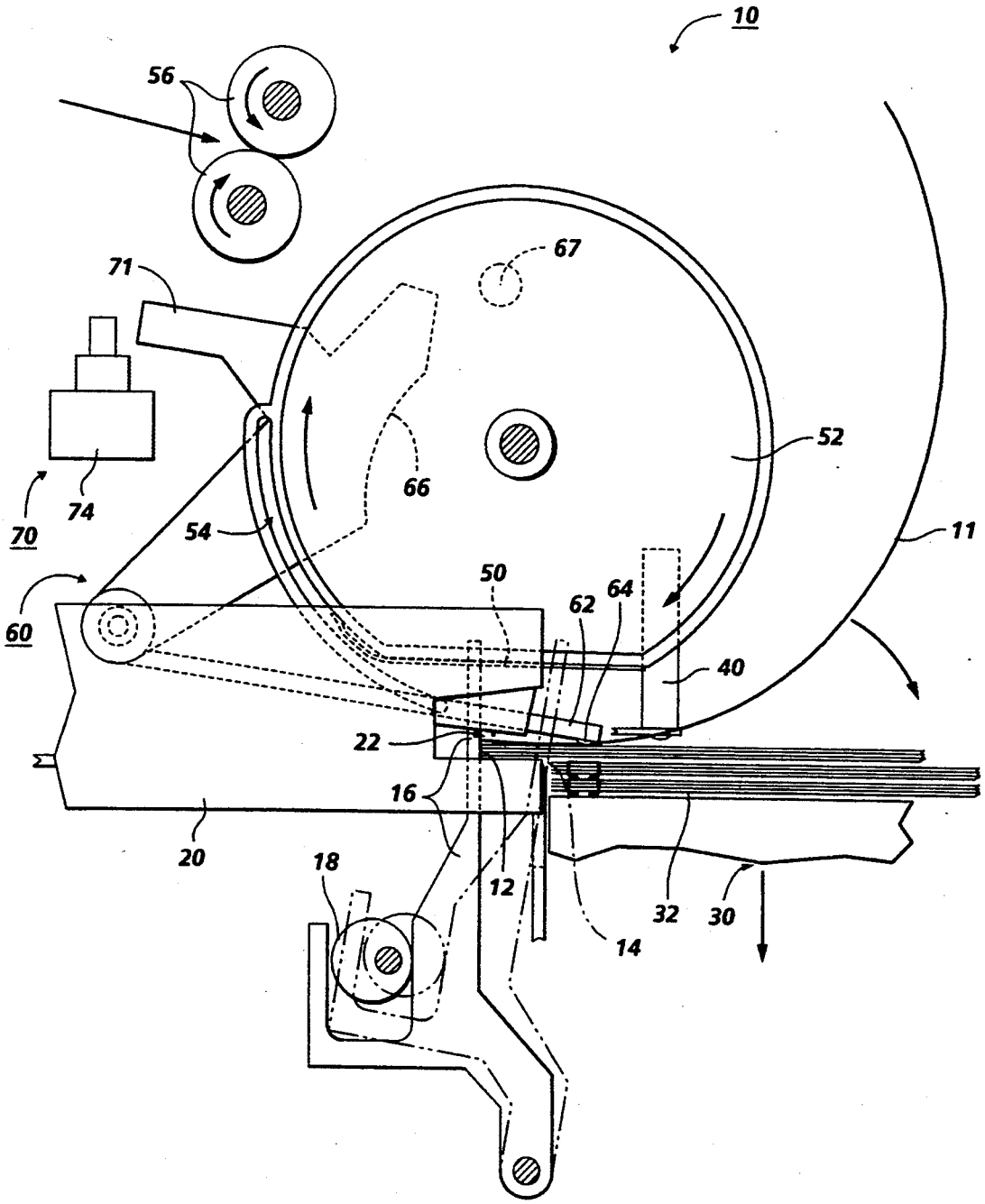
FIG. 5 is the same view as FIG. 4, but shown in the position of completing of stacking registration of a last sheet of a job set and the initiation of stapling of that set.

As noted, after the lead edge of a sheet has been inverted by the disk inverter unit, a long sheet needs to unroll its trail edge to finish inverting (see FIG. 5). As disclosed in the above cited U.S. Pat. No. 5,145,167, if desired, a set of flexible moving assistance belts may be located near and overlying the top of the discs and angled downwardly toward elevator platform 32. These belts can assist a long sheet to unroll its trail end area.

While the embodiment disclosed herein is preferred, it will be appreciated from this teaching that various alternatives, modifications, variations or improvements therein may be made by those skilled in the art, which are intended to be encompassed by the following claims:

What is claimed is:

1. A sheet inverting and stacking system in which a rotatable sheet stacking unit receives the lead edge area of an incoming sheet and then rotates the received sheet lead edge area and releases that lead edge area of the sheet at a lead edge registration position for stacking the sheet inverted in a compiled set of stacked sheets at least partially on a stacking tray in a stacking area:

a plural position movable sheet registration system providing plural said sheet lead edge registration positions;

a sheet set fastening system for fastening the inverted compiled sets of stacked sheets;

said plural position movable sheet registration system providing a first registration position for set fastening in which said sheet stacking area of the sheets being compiled inverted extends into said sheet set fastening system;

said plural position movable sheet registration system providing a second registration position in which said sheet stacking area is in front of said sheet fastening system; and said rotatable sheet stacking unit comprising rotating sheet retaining slot elements interdigitating with said plural position movable registration system to carry the sheet lead edge directly into said first and second registration positions and also into said sheet fastening system in said first registration position.

2. The sheet inverting and stacking system of claim 1, wherein said first and second registration positions provide two different initial sheet leading edge stacking positions, but only one final sheet stacking position.

3. The sheet inverting and stacking system of claim 1, wherein said movable sheet registration system is automatically moved from said first registration position to said second registration position after said sheet set fastening system has fastened a compiled set of stacked sheets so as to stack fastened sets in said second registration position.

4. The sheet inverting and stacking system of claim 1, wherein sheets stacked in said first registration position are stacked in substantially the same plane as sheets stacked in said second registration position.

5. The sheet inverting and stacking system of claim 1, wherein said sheet set fastening system comprises a stapler with open stapling jaws extending through said first registration position.

6. The sheet inverting and stacking system of claim 1, wherein said movable sheet registration system is a plural mode system providing an upstanding sheet lead edge registration wall for set compiling, a fastened sheet set ejector, and a plural sets registration wall, in respective said modes thereof.

7. The sheet inverting and stacking system of claim 1, wherein the distance between said first and second registration positions is less than about 3 cm.

8. The sheet inverting and stacking system of claim 1, wherein said sheet lead edge sheet retaining elements include low force retaining spring members therein which lightly hold the lead edge of the sheet against one side of a slot but do not substantially resist the entrance or exit of the sheet lead edge from said slot.

9. The sheet inverting and stacking system of claim 5, wherein said stapler is under said rotatable sheet stacking unit, and said slot elements of said rotatable sheet stacking unit carries the lead edge area of the incoming sheet directly up to said first registration position and into said stapler before releasing it.

10. The sheet inverting and stacking system of claim 9, wherein said stapler is stationary and at least partially inside of said rotatable sheet stacking unit.

11. The sheet inverting and stacking system of claim 8 further including a lateral sheet tamping system, wherein said lateral sheet tamping system engages the side of a sheet in said slots opposite from said fastening system to move the sheet into said fastening system.

12. The sheet inverting and stacking system of claim 11, wherein said low force retaining springs assist in the control of lateral tamping of a sheet lead edge in said slots.

* * * * *